US012378774B2

(12) United States Patent
Olson et al.

(10) Patent No.: US 12,378,774 B2
(45) **Date of Patent: *Aug. 5, 2025**

(54) PANELS WITH VENTILATION ELEMENTS

(71) Applicant: LOUISIANA-PACIFIC CORPORATION, Nashville, TN (US)

(72) Inventors: Lance Olson, Nashville, TN (US); Jarrod Kevin Line, Brentwood, TN (US)

(73) Assignee: LOUISIANA-PACIFIC CORP., Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/103,975

(22) Filed: Jan. 31, 2023

(65) Prior Publication Data

US 2023/0167643 A1 Jun. 1, 2023

Related U.S. Application Data

(63) Continuation of application No. 16/877,527, filed on May 19, 2020, now Pat. No. 11,566,430, which is a continuation-in-part of application No. PCT/US2018/064121, filed on Dec. 5, 2018, and a continuation-in-part of application No. 16/211,041, filed on Dec. 5, 2018, now Pat. No. 10,655,321.

(60) Provisional application No. 62/594,656, filed on Dec. 5, 2017.

(51) Int. Cl.

| | |
|---|---|
| ***E04F 13/00*** | (2006.01) |
| ***E04B 1/70*** | (2006.01) |
| ***E04F 13/08*** | (2006.01) |

(52) U.S. Cl.
CPC ..... *E04F 13/007* (2013.01); *E04B 1/7069* (2013.01); *E04F 13/0864* (2013.01)

(58) Field of Classification Search
CPC ..... E04B 1/70; E04B 1/7053; E04B 1/7069; E04B 1/7076; E04F 13/0864; E04F 13/007; E04F 13/00; E04F 17/04; E04F 17/00; E04F 13/0869
USPC ..... 52/302.1, 309.3, 302.6, 302.7
See application file for complete search history.

(56) References Cited

U.S. PATENT DOCUMENTS 3,339,325 A * 9/1967 Knapp ..... E04F 13/0885 52/390
8,440,289 B2 * 5/2013 De Giuseppe ..... B32B 5/028 428/167

(Continued)

*Primary Examiner* — Chi Q Nguyen
(74) *Attorney, Agent, or Firm* — Wayne Edward Ramage; Baker Donelson

(57) ABSTRACT

A plurality of ventilation elements, vents, slots, or gap elements or similar features that are applied to, or machined into, one or more sides or faces of exterior siding products. When the exterior siding product is installed, the ventilation elements, vents, slots, or gap elements or similar features provide a built-in air and water gap to facilitate and increase water drainage and air circulation behind the siding or panel, thereby minimizing water storage in the space behind the product and lowering the equilibrium moisture content of the siding itself. The ventilation features are incorporated into the corresponding product in-line or during the manufacturing process, and do not require any further work during assembly or construction on-site (e.g., furring strips or other similar drainage mechanisms are not needed).

13 Claims, 9 Drawing Sheets

(56) References Cited

U.S. PATENT DOCUMENTS

| | | | | |
|---|---|---|---|---|
| 8,919,061 | B2 * | 12/2014 | Kortuem | E02D 31/02 52/302.3 |
| 9,963,887 | B2 * | 5/2018 | Norwood | E04B 1/7076 |
| 10,655,321 | B2 * | 5/2020 | Olson | E04F 13/148 |
| 11,186,998 | B2 * | 11/2021 | Norwood | E04F 13/072 |
| 11,274,437 | B2 * | 3/2022 | Gonzales | B32B 27/12 |
| 11,566,430 | B2 * | 1/2023 | Olson | E04B 1/7069 |
| 2009/0193738 | A1 * | 8/2009 | Kortuem | E02D 31/02 52/302.1 |
| 2010/0189953 | A1 * | 7/2010 | Lim | E04D 11/00 428/140 |
| 2014/0093678 | A1 * | 4/2014 | Walker | E04C 2/34 428/161 |
| 2015/0047281 | A1 * | 2/2015 | Cole | E04B 1/762 52/302.1 |
| 2015/0176283 | A1 * | 6/2015 | Smiley, Jr. | E04D 13/172 52/302.1 |
| 2016/0319555 | A1 * | 11/2016 | Norwood | E04F 13/072 |

* cited by examiner

PANELS WITH VENTILATION ELEMENTS

This application is a continuation of U.S. Pat. No. 16/877,527, filed May 19, 2020, now U.S. Pat. No. 11,566,430, which is a continuation-in-part of U.S. patent application Ser. No. 16/211,041, filed Dec. 5, 2018, now U.S. Pat. No. 10,655,321, which claims benefit of and priority to U.S. Provisional Application No. 62/594,656, filed Dec. 5, 2017, all of which are incorporated herein by specific reference in their entireties for all purposes.

FIELD OF INVENTION

This invention relates to a siding or panel product with a plurality of built-in ventilation elements, vents, slots, or gap elements to increase water drainage and/or air circulation.

SUMMARY OF INVENTION

In various exemplary embodiments, the present invention comprises a plurality of ventilation elements, vents, slots, or gap elements or similar features that are applied to, or machined into, one or more sides (e.g., the back side) of exterior siding products, such as lap siding, panel siding, decorative trim, or other cladding materials. When the exterior siding product is installed, the ventilation elements, vents, slots, or gap elements or similar features provide a built-in air and water gap to facilitate and increase water drainage and air circulation behind the siding or panel, thereby minimizing water storage in the space behind the siding and lowering the equilibrium moisture content of the siding itself. The ventilation features are incorporated into the corresponding product in-line or during the manufacturing process, and do not require any further work during assembly or construction on-site (e.g., furring strips or other similar drainage mechanisms are not needed). An effective rain screen assembly thus is created without using furring strips or other form of drainage material, fabric or mat behind the exterior siding product, which results in extending the life of the assembly by reducing the probability of fungal and/or mold growth.

In additional embodiments, some or all of the ventilation features or elements improve the product's ability to equilibrate (moisture-wise) before installation as well as after installation. Prior to installation, the ventilation features or elements allows increased airflow between pieces of the product when stacked, thereby allowing accelerated equilibrium of the pieces of product in the middle or the interior of the stack (in the absence of the present invention, product in a stack will differentially equilibrate, as pieces of the product in the middle or the interior of the stack will not be exposed to air flow). Accelerated equilibrium minimize the amount of expansion or contraction of the product after installation. This stabilization of the product provides greater ease and flexibility in installation and lower probability of post-installation issues such as, but not limited to, buckling, shrinkage, excessive vapor drive through the paint, and other similar issues.

DETAILED DESCRIPTION OF EXEMPLARY EMBODIMENTS

In various exemplary embodiments, the present invention comprises a plurality of ventilation elements, vents, slots, or gap elements or similar features that are applied to, or machined into, one or more faces or sides (e.g., the back side) of exterior siding products, including, but not limited to, lap siding, panel siding, vertical siding, horizontal siding, flat (or non-overlapping) siding, flap siding, decorative trim, trim system components or other forms of panels or cladding materials. When the exterior siding product is installed, the ventilation elements, vents, slots, or gap elements or similar features provide a built-in air and water gap to facilitate and increase water drainage and air circulation behind the siding or panel, thereby minimizing water storage in the space behind the product and lowering the equilibrium moisture content of the product itself. The ventilation features are incorporated into the corresponding product in-line or during the manufacturing process, and do not require any further work during assembly or construction on-site (e.g., furring strips or other similar drainage mechanisms are not needed). An effective rain screen assembly thus is created without using furring strips or other form of drainage material, fabric or mat behind the exterior siding product, which results in extending the life of the assembly by reducing the probability of fungal and/or mold growth.

In additional embodiments, some or all of the ventilation features or elements improve the product's ability to equilibrate (moisture-wise) before installation as well as after installation. Prior to installation, the ventilation features or elements allows increased airflow between pieces of the product when stacked, thereby allowing accelerated equilibrium of the pieces of product in the middle or the interior of the stack (in the absence of the present invention, product in a stack will differentially equilibrate, as pieces of the product in the middle or the interior of the stack will not be exposed to air flow). Accelerated equilibrium minimize the amount of expansion or contraction of the product after installation. This stabilization of the product provides greater ease and flexibility in installation and lower probability of post-installation issues such as, but not limited to, buckling, shrinkage, excessive vapor drive through the paint, and other similar issues.

Figure 1:
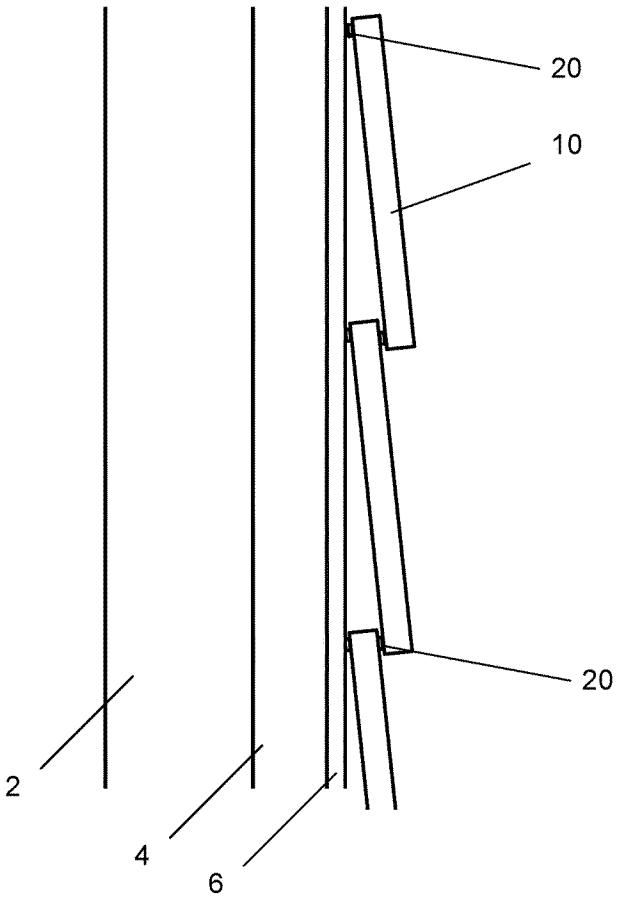
FIG. 1 shows a cross-sectional view of a siding assembly with lap siding product with top and bottom ventilation features in accordance with an embodiment of the present invention.

FIG. 1 shows a side cutaway view of an exemplary wall assembly with lap siding with ventilation features. OSB 4 or similar sheathing is affixed to a wall or frame stud 2, and a wall wrap 6 (e.g., weather resistant barrier, WRB, Tyvek, felt, or the like) is applied to the exterior side of the OSB sheathing 4. Exterior-facing siding sheathing 10 (e.g., lap siding, or siding panels) is then affixed over the wall wrap. Row of ventilation features 20 are positioned across the top and bottom of the back side or face of the siding sheathing 10, adjacent or proximate the top edge or bottom edge. As seen, the top ventilation features contact the wall wrap (or OSB sheathing, if no wall wrap is used) and provide a series of ventilation gaps between the features allowing the passage of water and/or air. Similarly, the bottom ventilation features contact the top exterior face of the lap siding or panel below, and provide a series of ventilation gaps between the features allowing the passage of water and/or air. Variations of this configuration can be used.

Figure 2:
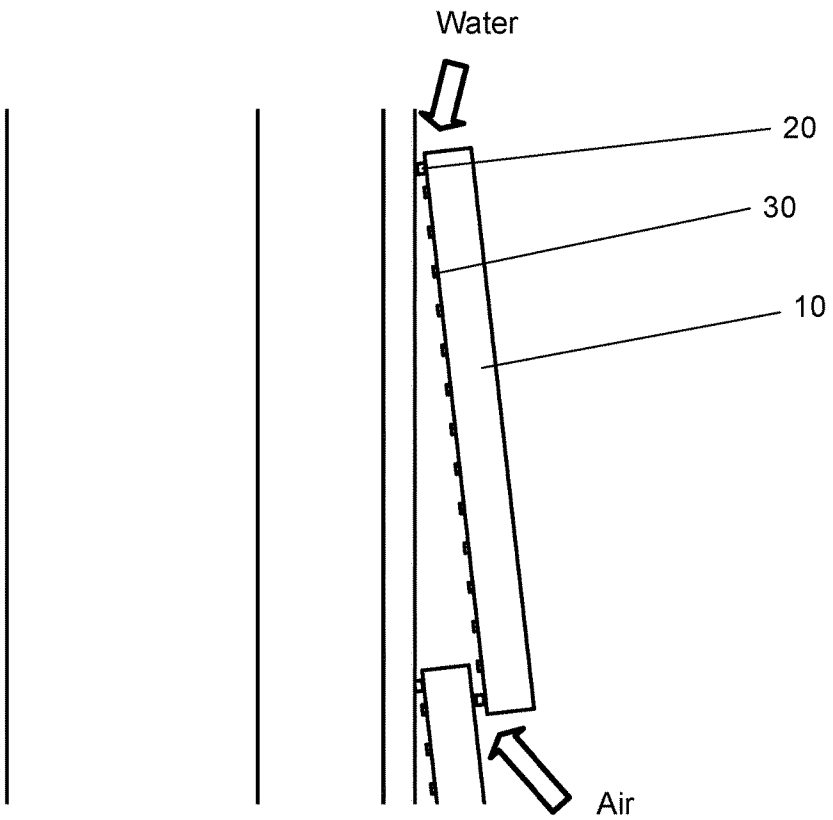
FIG. 2 shows a cross-sectional view of the lap siding product of FIG. 1 with additional ventilation features.
Figure 3:
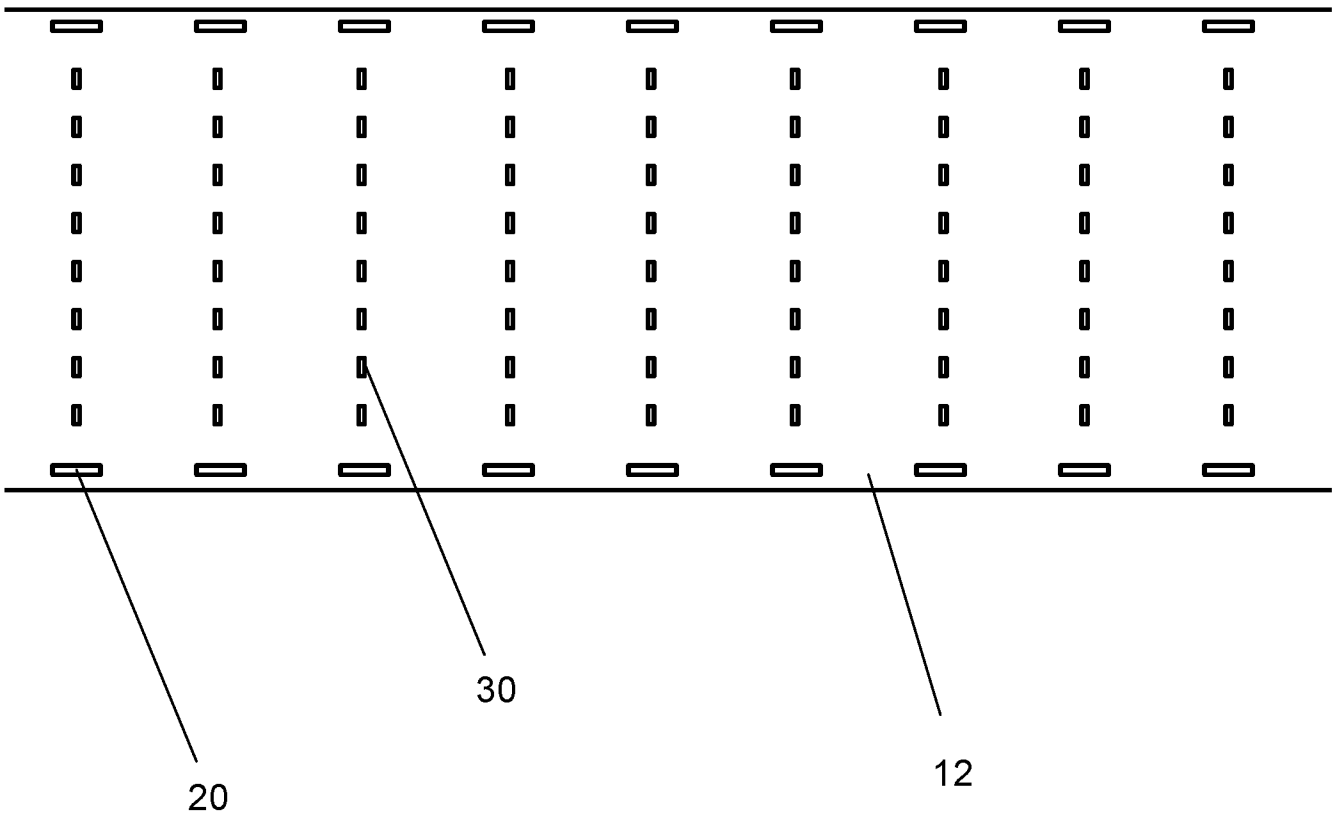
FIG. 3 shows a back view of a section of the lap siding product of FIG. 2.

FIGS. 2 and 3 show additional views of the top and bottom edge ventilation features 20 in combination with a variety of central or middle ventilation elements 30. FIG. 2 shows a cross-sectional view similar to FIG. 1, but with a series of middle ventilation elements 30 running down the back of the lap siding sheathing 10. FIG. 3 shows a view of the back of a single lap siding panel (oriented horizontally, as it would be applied in FIG. 1), showing both forms of ventilation features in more detail. The top and bottom ventilation features 20 here comprise a series of raised elements, strips, or beads located along or proximate the upper and lower edges of each lap panel. In one embodiment, each raised feature 20, 30 is ¾" to 1" long, and ⅛" to ¾" high. When in linear form, the width of each element is less than the length, but generally not less than approximately 1/16" in width (e.g., in one embodiment, approximately ⅛" to ½" in width). The features 20 shown here are linear, and extend lengthwise parallel to the upper and lower edges of the siding sheathing 10, although other shapes and alignments are possible. These features provide for a plurality of fixed gaps or spacing at the lap joint and at the wall connection when assembled, as seen in FIGS. 1 and 2. (While the figures herein show various combinations of ventilation features and other similar elements on either a piece of lap siding or panel siding, the various combinations shown can be used on other types of siding, or on other strips, planks, panels or similar products.)

The middle ventilation features 30 are shown here as a plurality of vertical columns of raised elements extend vertically between the upper and lower edges of each piece of lap siding or panel. The features 30 in the vertical columns may differ in size (length, width, and/or thickness) from the top/bottom raised elements 20. In one embodiment, all elements are the same height/thickness. In another embodiment, the top/bottom raised elements 20 are greater in height/thickness than the central elements 30. The top elements also may be greater or lesser in height that the bottom elements, and the central elements likewise may differ in height among themselves. As described below, the vertical columns of middle elements 30 also may facilitate stacking of the lap siding or panel sheathing for shipping, and allow for air and water ventilation when stacked while preventing bowing of or damage to the panels.

Figure 4:
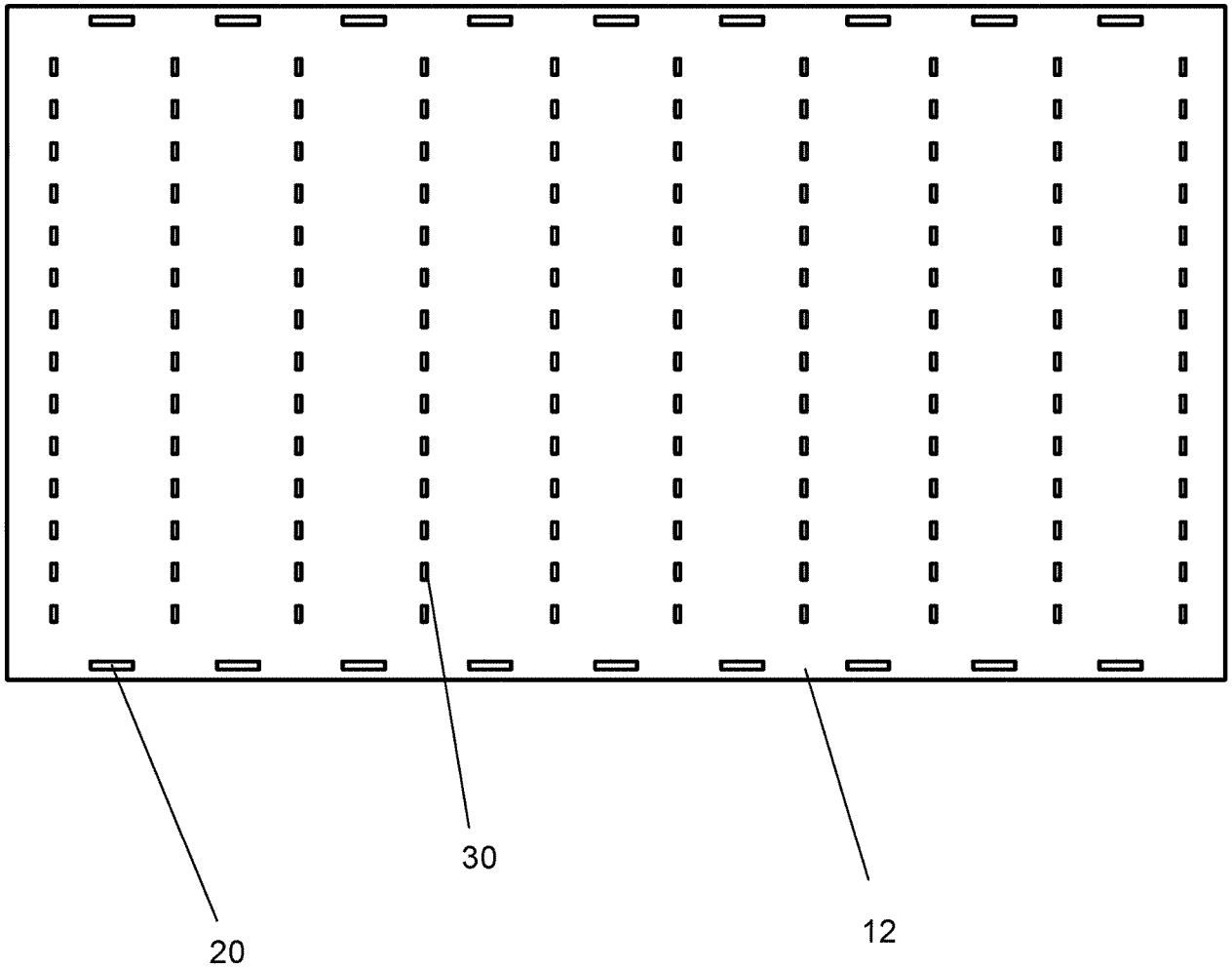
FIG. 4 shows an alternative configuration of ventilation features on the back of a panel siding product.

The vertical columns of middle elements 30 may be aligned with the top/bottom elements 20, as seen in FIG. 3, or may be offset therefrom, as seen in FIG. 4. Various configurations and alignments of elements may be used to variously provide straight or unobstructed ventilation channels, whether unidirectional, bidirectional, or multi-directional, or more distributed or greater or consistent support across the width and length of the sheathing panel.

Figure 5:
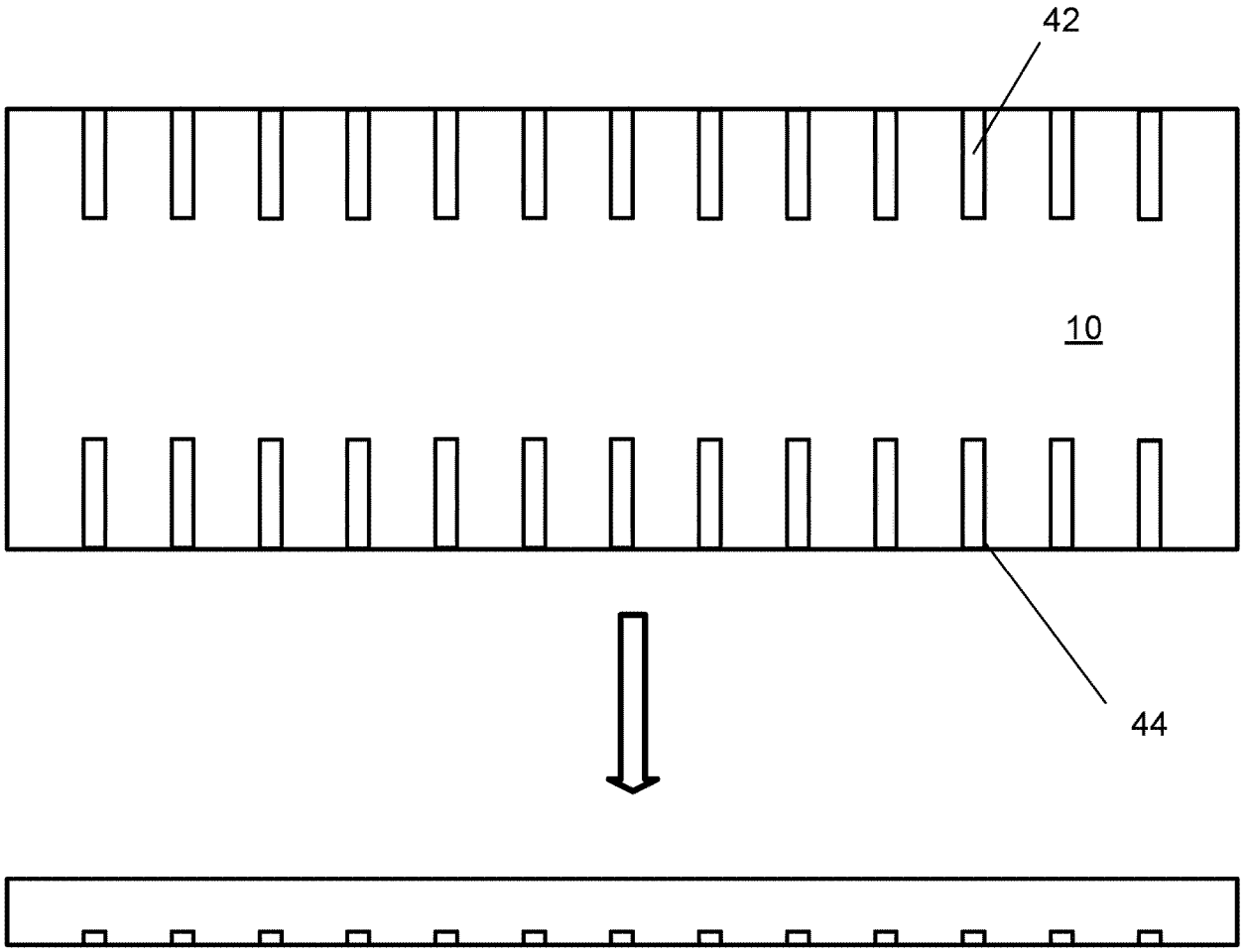
FIG. 5 shows a back view of a lap siding product with ventilation or drainage channels in accordance with another embodiment of the present invention.

FIG. 5 shows another embodiment of the present invention, with a portion of a piece of lap siding with a plurality of ventilation or drainage slots or channels 42, 44 cut into the back side (e.g., in the bottom layer of a multilayered manufactured wood product) of the lap siding product along the upper 42 and lower edges 44. When assembled (such as seen in FIG. 1), the slots create drainage/ventilation channels and facilitate air and water flow at the lap joint and at the wall connection. In alternative embodiments, channels may be positioned only along the top or along the bottom. Each channel has an opening along the bottom or top edge, respectively, and extends for some distance towards the interior. In some embodiments, a channel extends from the top edge continuously to the bottom edge. While FIG. 5 shows the channels as extending at substantially right angles relative to the top or bottom edges, the channels may extend straight at non-right angles, or may be S-shaped or curved, or combinations thereof. The channels may also be used alone, or in various combinations with the raised ventilation features described above.

Figure 6:
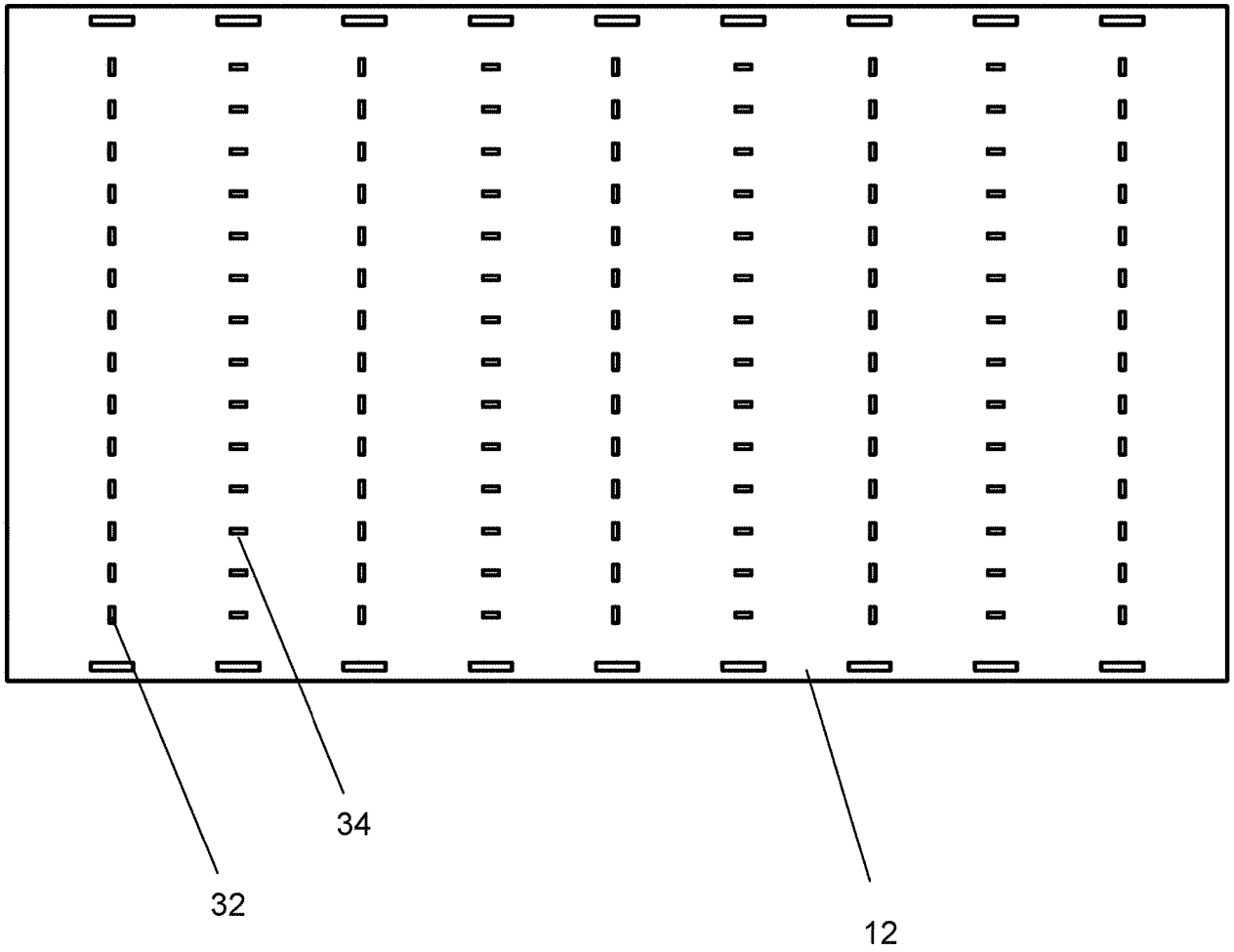
FIG. 6 shows a back view of a panel siding product with ventilation features in accordance with another embodiment of the present invention.

FIG. 6 shows an embodiment of the present invention where a plurality of raised features 32, 34 are applied to the back side of a panel siding product (such as where the panel is 4'×8' or larger). The top/bottom raised features described above may or may not be present. Each raised element, when in linear form, may be ½" to 1" long, and ⅛" to ¾" high, and spaced 2" to 4" from adjacent elements. Width may be as described above with regard to features 20, 30. In other embodiments, different dimensions and/or spacing may be used. In one embodiment, each column of elements is similarly aligned (e.g., all horizontal or all vertical), with columns alternating in alignment (the same may be true for rows). The raised features in alternating columns (or rows) can be vertically aligned, as shown, or offset. As seen in FIGS. 6, the plurality of raised features 32 overlap, at least in part, with the plurality of raised features 34. In the embodiment shown, raised features 32 do not contact raised features 34.

Figure 7:
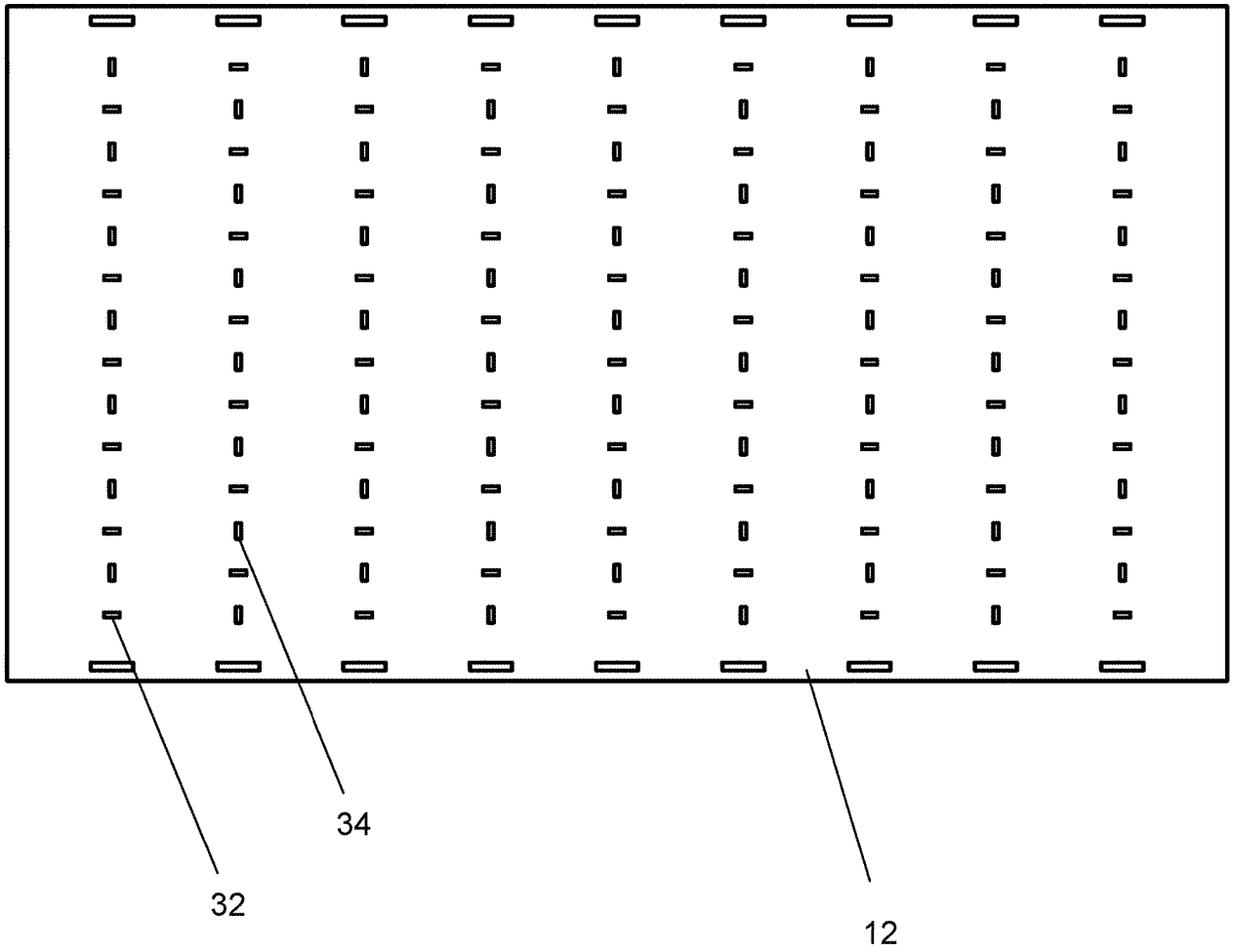
FIG. 7 shows an alternative configuration of ventilation features for the panel siding product of FIG. 6.

In another embodiment, the features in a column also may alternate alignment, as seen in FIG. 7. In the configuration shown, the plurality of raised features 32 also overlap, at least in part, with the plurality of raised features 34. These configurations allow a siding panel to be installed either vertically or horizontally. The elements facilitate stacking of the lap panels for shipping, and allow for air and water circulation when stacked while preventing bowing of or damage to the panels.

Figure 8:
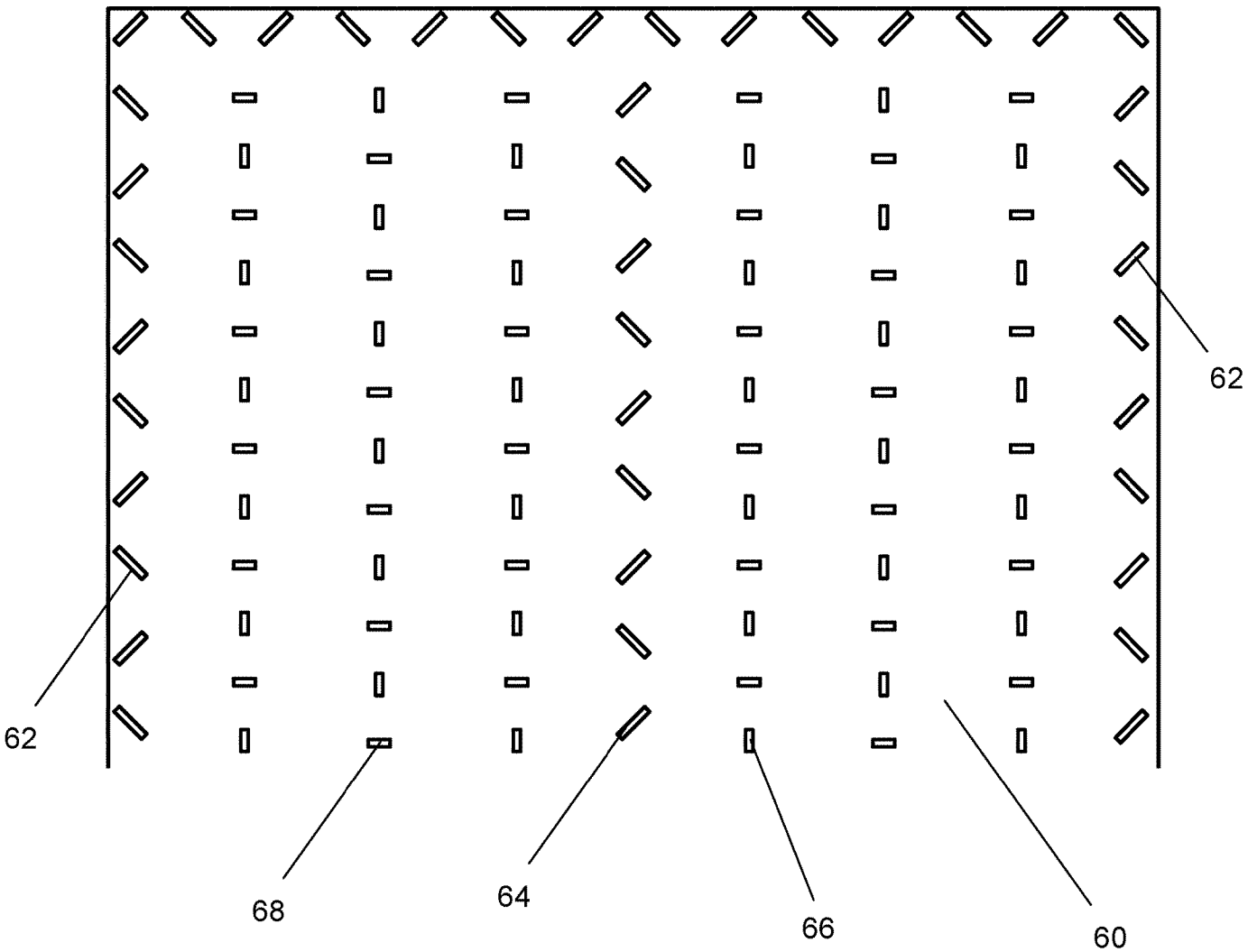
FIG. 8 shows a back view of a panel siding product with multiple patterns of ventilation features positioned for various installation or stacking arrangements.
Figure 9:
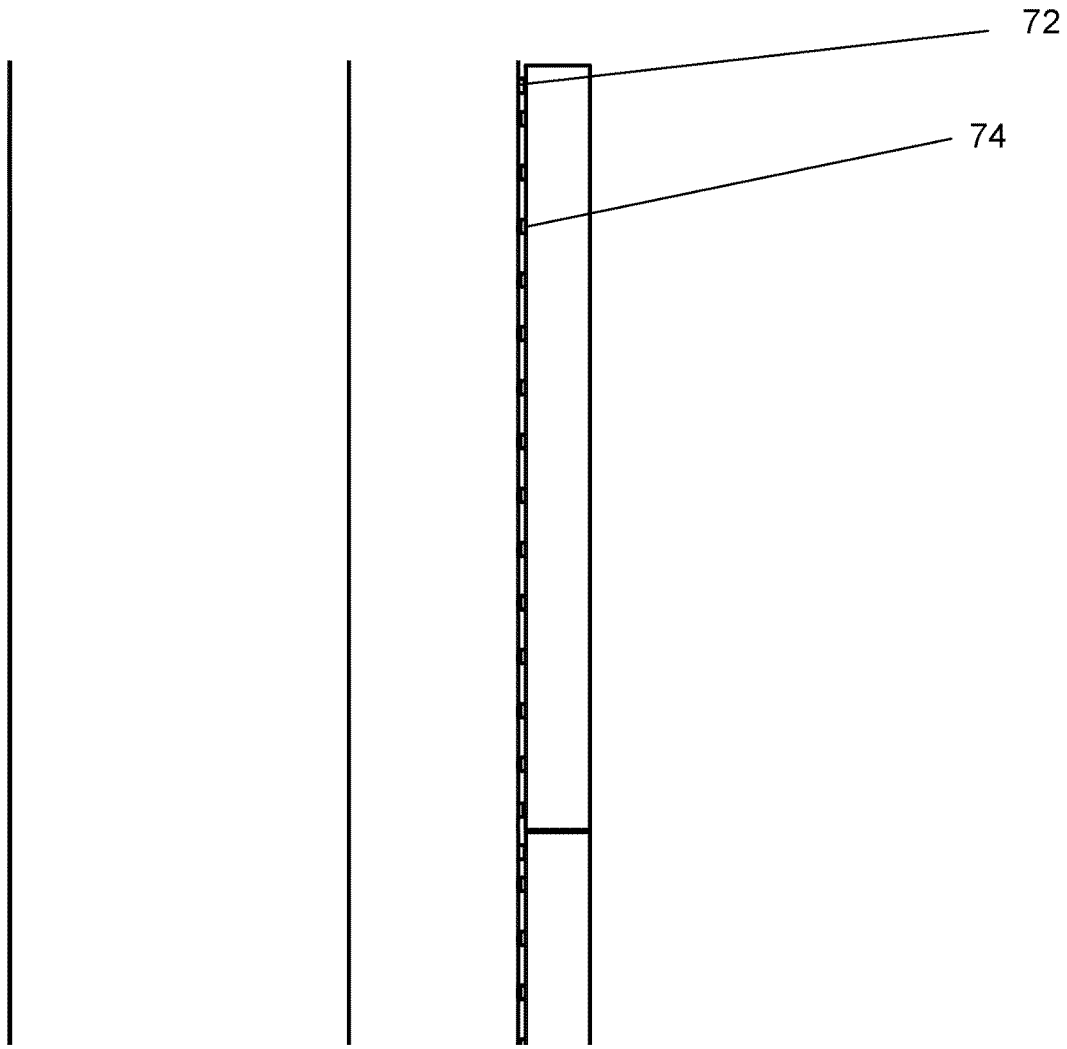
FIG. 9 shows a cross-sectional view of a flat, vertical or horizontal siding assembly with ventilation features in accordance with an embodiment of the present invention.

In several embodiments, multiple forms and arrangements of ventilation features are applied to the same panel or board. For example, FIG. 8 shows an example of a portion of the back of a panel 60 with multiple orientations and forms of ventilation elements. The panel shown is 4'×8', although the panel may be other sizes, such as, but not limited to 16" or 12" wide by 8' or 16' long. The panel siding may be, but is not limited to, vertical siding, horizontal siding, lap panel siding, flat panel siding, flap siding, or trim panels or components. FIG. 9 shows a cross-sectional view of a siding assembly with multiple adjacent panels. It should be noted that such panels may be placed in multiple layers, such as offset trim panels.

In several embodiments, the outside product edges contain a series of alternating orientation angled linear features 62 (which are shown at an angle to the edges), in a strip within up to 6" from the edge (in one preferred embodiment, the features are located within a strip up to 1" from the respective edge). One or more similar strips of alternating orientation angled linear features 64 extend across the middle of the panel (in the figure shown, a single interior strip up to approximately 6" wide, preferably up to 1" wide, extends down the center section of the panel; in the embodiment shown, a single interior strip extends down the center, 24" from either long edge). These features provide drainage when attaching the panel over one or more studs during installation, and are designed to correspond to stud placement (these strips thus may extend horizontally, vertically, or both, depending on the installation).

Further, additional ventilation features 66, 68 may be provided on the interior of the back side of the panel to provide ventilation for when the product is installed or stacked, as described above. The placement in the interior helps to keep the panels slightly separated from stacked, and these additional ventilation features may comprise a third 66 and fourth 68 alternating orientation to the stud features (e.g., alternating perpendicular and parallel to a panel edge, as shown). The stack ventilation features also may be used for providing ventilation and/or drainage for other forms of installation of the product. It should be noted that, as seen in FIG. 9 additional ventilation features 66 overlap, at least in part, with ventilation features 68, but do not overlap with raised features 32.

In several embodiments, the interior ventilation features 72, 74 help to provide ventilation when the product is installed, and may extend to the top, bottom, and/or side edges of the product, thereby taking the place of or acting as the angled linear features 62. The interior ventilation features may be in the size range described above for other ventilation features. In alternative embodiments, the ventilation features may be approximately 1/32" to 11/32" inches in height, 1 mm to 10 mm in height.

The different features may vary in thickness, length, and composition, in addition to orientation and arrangement. In the example shown in FIG. 8, the features' thickness may range from 1/8" to 1/2".

In another embodiment, alternative, non-linear shapes are applied to the features in these strips corresponding to the stud placement, and in the field in between to aid in stacking of materials into bundles.

In some embodiments, a starter strip is used to start the installation of lap siding. The starter strip can be a specially designed strip installed on the wall at the bottom of the installation (as a base for the first row of lap siding), although many times a starter strip is cut from a piece of the lap siding being used for the project. This area is often a point of trapped moisture and restricted ventilation. While a bottom edge ventilation element 20 on the row of lap siding being installed over the starter strip may provide ventilation, in some installations the starter strip itself may comprise one or more lines of ventilation elements (as described above) on its exterior face or side.

The siding or cladding may be manufactured from a variety of materials utilized for such purposes, including, but not limited to, wood, engineered wood composites (e.g., OSB, LVL, and the like), and cellulose fiber cement.

The product can be manufactured using several different processes. Material can be attached to the back of the siding creating a pattern of raised points that facilitate drainage and ventilation. In several embodiments, as detailed below, the pattern or patterns are not omnidirectional. Specific shapes of polymer or other materials can be applied to the backside of the product or board backer. These shapes include, but are not limited to, thin and thick lines, ridges, or linear features of various lengths and angles, dots, circles and other shapes which impart certain properties. This process allow for shapes of various sizes and thicknesses to be applied to optimize cost and product performance. Polymer or other materials which could be applied include but not limited to heat sensitive materials, 2-part resins, and other forms of solid materials adhered to the panel or board.

In various of the figures shown, the additive technologies add hard polymer shapes as ventilation features around the outside edge and center of the panel to provide gaps between the panel and wall (or between adjacent panels in a pre-installation stack) for air circulation and moisture drainage.

The drainage and ventilation feature(s) can also be machined into the product using saws, routers or other types of tooling, or they can be pressed into the product to create a woven, dimpled or other contoured surface.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A panel product, comprising:

a wood-based panel comprising a first face, a second face, a top edge, a bottom edge, a right edge, and a left edge;

a first plurality of first raised ventilation elements with a longitudinal axis, said first raised ventilation elements projecting from the first face;

a second plurality of second raised ventilation elements with a longitudinal axis, said second raised ventilation elements projecting from the first face;

wherein the first plurality of first raised ventilation elements and the second plurality of second raised ventilation elements overlap at least in part, but the first raised ventilation elements and the second raised ventilation elements do not contact each other; and wherein the first raised ventilation features are oriented at an angle to the second raised ventilation features so that the longitudinal axis of the first raised ventilation elements is not parallel to the longitudinal axis of the second raised ventilation features.

2. The panel product of claim 1, wherein the first and second raised ventilation elements are attached to the first face of the panel.

3. The panel product of claim 1, wherein the first and second raised ventilation elements are polymers.

4. The panel product of claim 1, wherein the first plurality of first raised ventilation elements and the second plurality of second raised ventilation elements are arranged to provide ventilation and drainage whether the panel is installed in a vertical or horizontal orientation.

5. The panel product of claim 1, further comprising:

a third plurality of third raised ventilation elements projecting from the first face; and a fourth plurality of fourth raised ventilation elements projecting from the first face;

wherein the third plurality of third raised ventilation elements and the fourth plurality of fourth ventilation elements overlap at least in part, but do not overlap with the first set of ventilation elements.

6. The panel product of claim 5, wherein the third plurality of third raised ventilation elements are positioned to provide ventilation between adjacent panels in a multiple-panel stack.

7. The panel product of claim 5, wherein the third plurality of third raised ventilation elements are positioned to accelerate equilibration by the panel.

8. The panel product of claim 1, wherein the panel is a lap siding panel.

9. The panel product of claim 1, wherein the panel is a flat siding panel.

10. The panel product of claim 1, wherein the panel is a vertical siding panel.

11. The panel product of claim 1, wherein the panel is a trim panel.

12. The panel product of claim 1, wherein the panel is a cladding panel.

13. The panel product of claim 1, wherein the first face is the inner face of the panel.

* * * * *